US007021575B2

(12) United States Patent
Eno et al.

(10) Patent No.: US 7,021,575 B2
(45) Date of Patent: Apr. 4, 2006

(54) WASTE PULPING SYSTEM

(75) Inventors: Steven M. Eno, Lancaster, PA (US); Neil B. Smith, Lancaster, PA (US)

(73) Assignee: Premark FEG L.L.C., Wilmington, DE (US)

( * ) Notice: Subject to any disclaimer, the term of this patent is extended or adjusted under 35 U.S.C. 154(b) by 91 days.

(21) Appl. No.: 10/829,050

(22) Filed: Apr. 21, 2004

(65) Prior Publication Data

US 2004/0195410 A1 Oct. 7, 2004

Related U.S. Application Data

(62) Division of application No. 10/145,473, filed on May 14, 2002, now Pat. No. 6,776,365.

(60) Provisional application No. 60/363,679, filed on Mar. 12, 2002.

(51) Int. Cl.
*B02C 23/36* (2006.01)

(52) U.S. Cl. ..... 241/46.17; 241/285.2

(58) Field of Classification Search ..... 241/46.15, 241/46.17, 285.1, 285.2, 285.3, DIG. 30
See application file for complete search history.

(56) References Cited

U.S. PATENT DOCUMENTS 4,582,261 A 4/1986 Perry
5,577,674 A 11/1996 Altonji et al.

*Primary Examiner*—Mark Rosenbaum
(74) *Attorney, Agent, or Firm*—Mark W. Croll; Donald J. Breh; Lisa M. Soltis

(57) ABSTRACT

In a waste pulping apparatus, an impeller assembly comprises a rotating blade for pulping solid waste to form a slurry, the rotating blade having an axis of rotation, a base and a plurality of ears that axially extend away from the base. The impeller assembly also includes a sieve ring having axially opposed first and second ends, an inner cylindrical surface and an outer cylindrical surface, where the sieve ring encircles the base of the rotating blade at the first end so that a portion of the ears are radially spaced inside the inner cylindrical surface so that the ears rotate within the sieve ring. A plurality of pumping vanes are also provided for pumping the slurry, where each pumping vane has a pumping surface that rotates radially outside the outer cylindrical surface of the sieve ring. Preferably, the pumping vanes can be easily changed to allow for various head condition while providing a predetermined pumping capacity.

4 Claims, 9 Drawing Sheets

WASTE PULPING SYSTEM

This application is a division of U.S. patent application Ser. No. 10/145,473, filed May 14, 2002 now U.S. Pat. No. 6,776,365, which claims the benefit of U.S. Provisional Application No. 60/363,679, filed on Mar. 12, 2002.

BACKGROUND OF THE INVENTION

1. Field of the Invention

The present invention is directed to an apparatus for disintegrating solid waste to form a pulp for disposal.

2. Description of the Related Art

Waste reduction systems such as solid waste pulpers have been in use for many years. One such system is disclosed in Altonji et al., U.S. Pat. No. 5,577,674, assigned to the assignee of this application, the disclosure of which is incorporated herein by reference. In typical systems such as that in U.S. Pat. No. 5,577,674, waste from a kitchen or another waste source is placed into a pulping tank partially filled with water. A cutting or grinding mechanism is installed near the bottom of the tank and usually includes a rotating impeller with attached rotating blades that periodically come into play with stationary blades attached to a sieve ring. A grinding motor rotates the impeller, causing the blades to grind the solid waste into a pulp of small particles and circulate the water and solids within the tank. Waste particles that are sufficiently small to pass through the sieve ring are discharged from the tank and away from the pulping unit to an extractor to remove water from the slurry. In close-coupled systems such as in U.S. Pat. No. 5,577,674, the force of the rotating blade and a set of pumping ears are used to move the slurry a short distance to the extractor. In many prior art pulping systems, a slurry pump having a separate drive from the grinding motor is used to pump the slurry to a remote extractor.

Traditionally, the pulping capacity, or how much waste a pulper can process in a given period of time, has been thought to depend on the size of the pulper's components, specifically, the pulping tank volume and the rotating blade diameter. If a large pulping capacity was needed, a large tank and a large rotating blade were provided.

The slurry is usually sent to a liquid extractor for drawing water out of the slurry and returning the extracted water to the tank. In some pulping systems, a portion of the extracted water, or "return water," is directed to a feed tray where the solid waste is placed. The return water is used to flush the solids down the tray into the pulping tank.

Different downstream environments for pulpers and extractors are common in waste reduction systems. One is a close-coupled system, where the pulper and extractor are in close proximity to each other so that the slurry does not need to be pumped very far, usually a few feet or less, to reach the extractor. Another is a remote system where the pulper and extractor are not in close proximity and the slurry pump must move the slurry a much greater distance, as much as 100 feet or more.

It has been necessary for the pulping system to be designed depending on whether a close-coupled or a remote system will be used by a particular customer, and what type of pulping it will be used for. For example, two restaurants may order the same pulper and extractor, but place them in different configurations so that one restaurant has a remote system where the pulper and extractor might be 100 feet apart and the other has a close-coupled system that requires a pump with a much lower pumping capacity than the first restaurant. Different pumping capacities are needed in different pulping situations as well. One customer may need a system to pulp large amounts of heavy material so that the slurry pump or pumping ears are required to move more dense slurry than another customer who may not have as intense pulping needs.

Because of varying customer needs like the above examples, a supplier typically has been required to maintain an inventory of pumps or pumping ears of various capacities so that the system will provide the desired flow rate for the anticipated slurry. In the above examples, the supplier would have to have an inventory with at least a high capacity slurry pump for the pulper of the first restaurant, and a low capacity slurry pump or set of pumping ears for the pulper of the second restaurant.

A problem that can occur with pulpers is the buildup of fibrous debris at the sieve ring or rotating blades. This buildup, also known as "bridging" or "log jamming," can cause blockage of the sieve ring that can back up the pulping system which can have a negative impact on the pulping efficiency of the system.

Another problem associated with many pulpers is the translation of vibrations between the pulping tank and its surroundings, particularly to the frame of the pulper. In an exemplary case of this problem, pulpers may include a table as part of the frame so that a restaurant's employees may place dishes on the table to conserve space. As the pulper is used, vibration is translated to the frame from the tank, and then to the table, causing the dishes to vibrate. This can be very noisy as the dishes vibrate and clatter. This is very undesirable for the restaurant, as it is annoying and distracting to the customers and the employees.

Yet another problem that can occur with pulpers has to do with the feed tray. Many pulping systems operate at a flow rate which results in a turbulent, splashing flow of the return water within the feed tray. At high enough flow rates, the return water can splash wildly out of the tray. This would also be undesirable because the mess must be cleaned up repeatedly.

What is needed is a pulper that allows for easy modification between close-coupled systems and remote systems. Also what is needed is a pulper that keeps fibrous debris clear of the sieve ring and rotating blade to prevent blockage and backup of the pulping system. Further, what is needed is a pulper that minimizes the translation of vibrations between the pulping tank and its surroundings. Additionally, what is needed is a feed tray that minimizes splashing in the feed tray.

BRIEF SUMMARY OF THE INVENTION

In accordance with the present invention, an impeller assembly for a waste pulping apparatus is provided, the impeller assembly including a rotating blade for pulping the waste to form a slurry, the rotating blade having an axis of rotation, a base and a plurality of ears that axially extend away from the base. The impeller assembly also includes a sieve ring having axially opposed first and second ends, an inner cylindrical surface and an outer cylindrical surface. The sieve ring encircling the base of the rotating blade at the first end. At least a portion of the ears are radially spaced inside the inner cylindrical surface so that the ears rotate within the sieve ring. A plurality of pumping vanes are also provided for pumping the slurry, where each pumping vane has a pumping surface that rotates radially outside the outer cylindrical surface of the sieve ring. Preferably, the pumping vanes can be easily changed to allow for various head condition while providing a predetermined pumping capacity.

Also in accordance with the present invention, a waste pulping apparatus is provided having a tank for containing liquid and waste to be pulped and a slurry chamber adjacent to the tank. The impeller assembly is mounted to the tank at the slurry chamber and further includes at least one stationary blade adjacent to the inner cylindrical surface at the second end of the sieve ring and axially extending from the second end so that the stationary blade is in close proximity to the ears of the rotating blade.

Also in accordance with the present invention, a method of assembling an impeller assembly for a waste pulping apparatus is provided, the method including the steps of providing a rotating blade and a sieve ring of the impeller assembly described above, selecting a plurality of matching pumping vanes, each having a pumping surface for providing a predetermined pumping capacity against a predetermined head and connecting each one of the plurality of selected pumping vanes to the impeller so that each pumping surface rotates radially outside of the outer cylindrical surface of the sieve ring.

Also in accordance with the present invention, a waste pulping apparatus is provided, the apparatus including a tank for containing liquid and solids, the tank having an upper portion with a perimeter, a frame for supporting the tank, a means for pulping the liquid and solids within the tank, a shell having a lower portion with a perimeter, where the lower portion of the shell and the upper portion of the tank are nested defining a juncture between the tank and the shell at the perimeters. A seal is placed at the juncture for preventing the liquid and solids from leaving the tank and for minimizing the translation of vibrations between the tank and the shell, and a plurality of mounting brackets are placed between the tank and the frame for minimizing the translation of vibrations between the tank and the frame.

Also in accordance with the present invention, a feed system for a waste pulping apparatus is provided, the feed system including a tray for feeding the liquid and the solids into the tank, the tray having an inlet for receiving liquid and a width, and a means for distributing the liquid at the inlet of the tray for evenly distributing the liquid across the width of the tray. In one embodiment, the means for distributing the liquid is a dispersion plate at the inlet of the tray.

Also in accordance with the present invention, a waste pulping apparatus is provided including a tank having means for pulping waste solids into a slurry, a means for pumping the slurry where the pumping means are operatively connected to the tank, an extractor mounted proximate to the tank for receiving slurry and extracting liquid from the slurry, a return pump connected to the extractor for returning the liquid to the tank, wherein the extractor mount is a quick-release mount to facilitate easy access to the return pump.

These and other objects, features and advantages are evident from the following description of an embodiment of the present invention, with reference to the accompanying drawings.

DETAILED DESCRIPTION OF THE INVENTION

Figure 1:
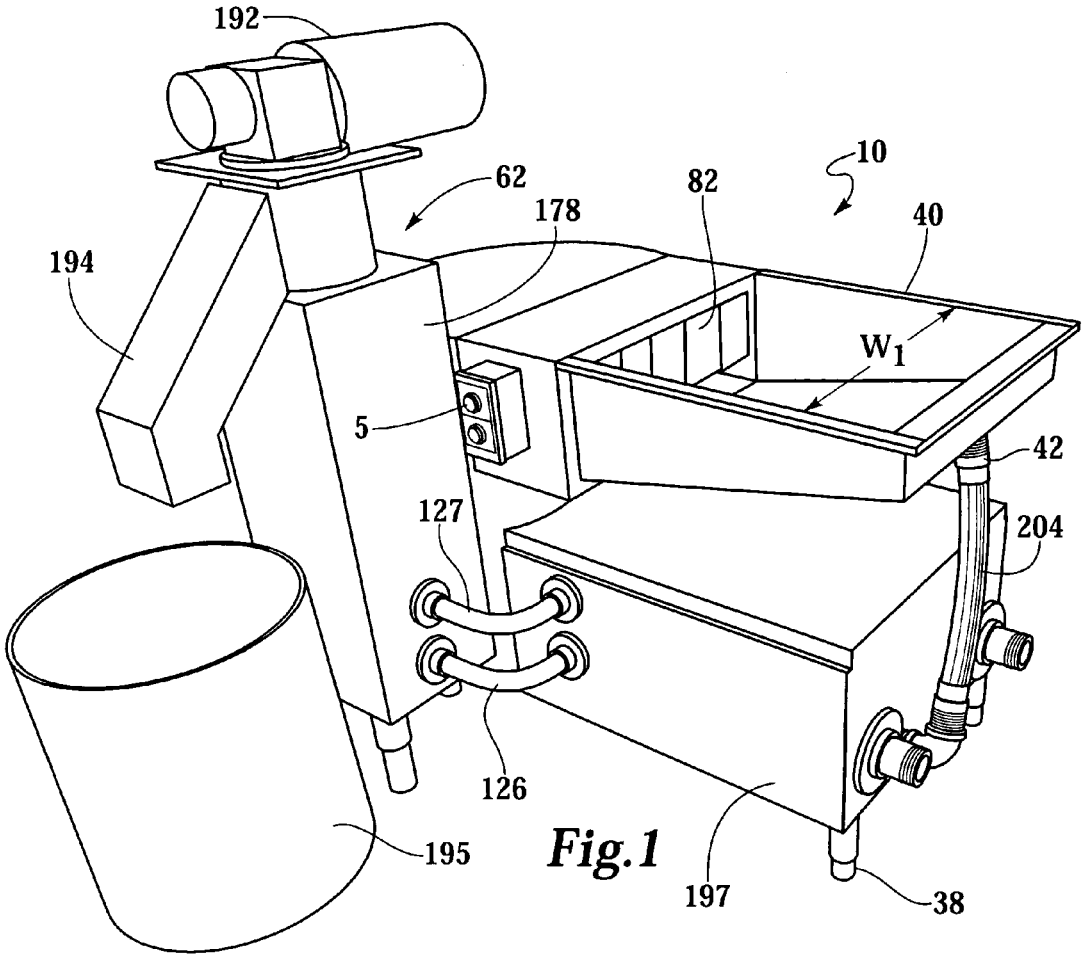
FIG. 1 is an isometric view of the pulping system.
Figure 2:
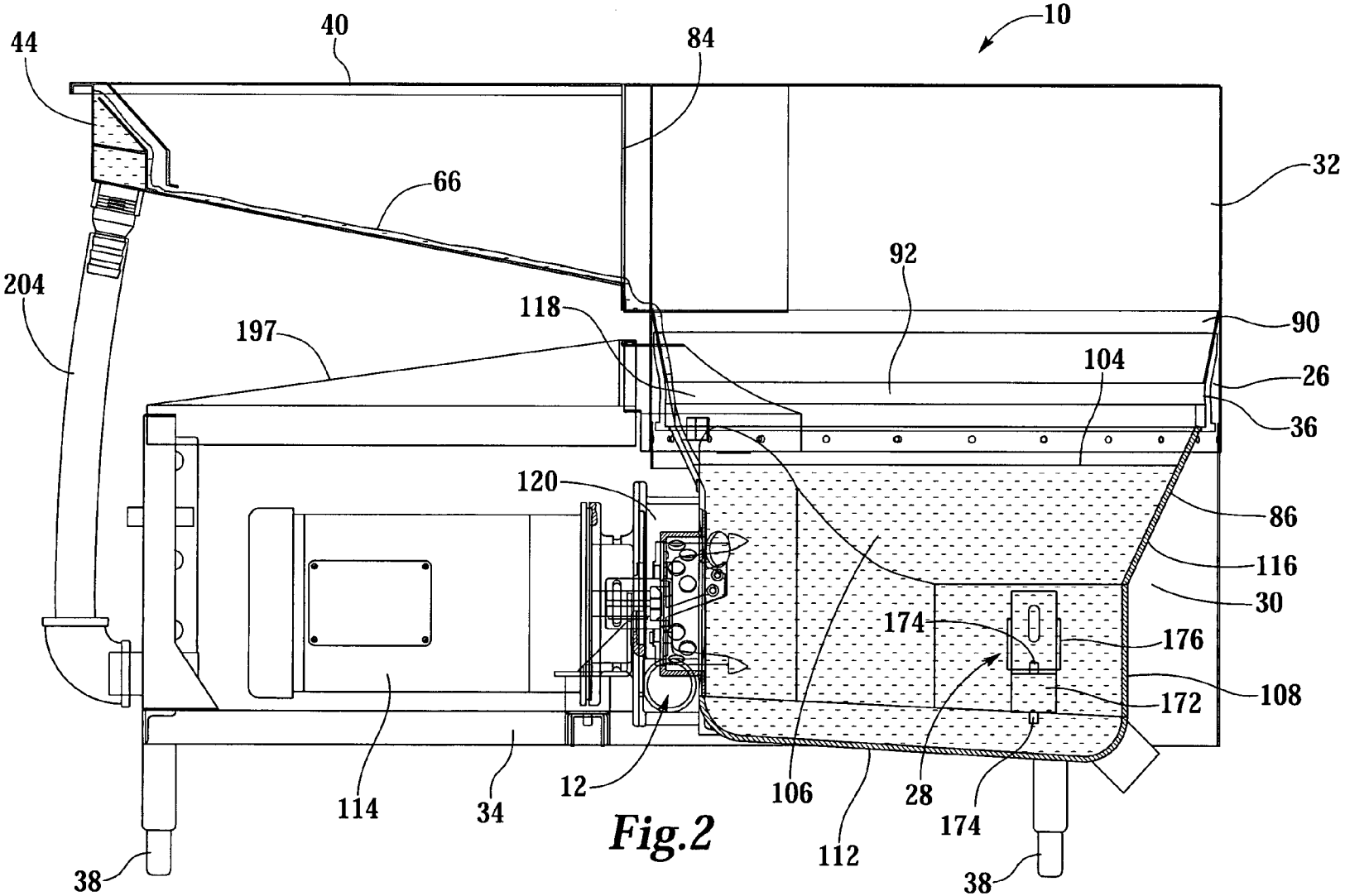
FIG. 2 is a side sectional view of the pulping system.

FIGS. 1 and 2 show overall views of a novel and improved pulping system 10 provided by the present invention for the pulping of solid waste material. The inventive pulping system 10 includes a pulping tank 30 and a novel and improved cutting mechanism 12, as shown in more detail in FIGS. 5, 6 and 7, which includes an impeller 14, a rotating blade 16, a sieve ring 18, stationary blades 20, interrupter bars 22, and pumping vanes 24. Pumping vanes 24 can be modularly changed to provide for different desired pumping capacities. Cutting mechanism 12 is also known as an impeller assembly. Cutting mechanism 12 is connected to a driving motor 114, which provides the energy for grinding waste into a slurry and the energy for pumping the slurry. Motor 114 is activated by a set of controls 5 on pulping system 10, see FIG. 1. Pulping system 10 is supported by a frame 34 and a set of supporting feet 38.

Pulping system 10 also includes a vibration seal 26 and a set of vibration mounting assemblies 28, as shown in FIG. 2, which minimize the translation of vibration between tank 30 and its surroundings, particularly between tank 30 and a support frame 34. Vibration seal 26 prevents translation of vibration between tank 30 and a shell 32 nested on top of tank 30 as well as preventing liquid and solids from leaking out of a juncture 36 between shell 32 and tank 30.

Feed Tray

Also included in pulping system 10 is a novel and improved feed tray 40, See FIGS. 2–4 and 12–14, which incorporates a liquid inlet 42 and a means for distributing liquid (shown as a dispersion plate 52 in FIGS. 2, 3 and 14) so that the liquid is evenly distributed across the full width W1 of feed tray 40 to flush solid waste placed on feed tray 40 into tank 30 for pulping.

Figure 3:
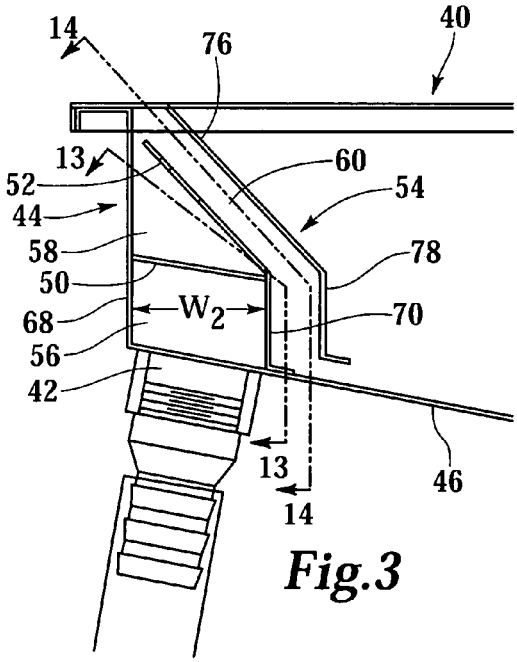
FIG. 3 is an enlarged side sectional view of the housing of the feed tray as shown in FIG. 2.
Figure 4:
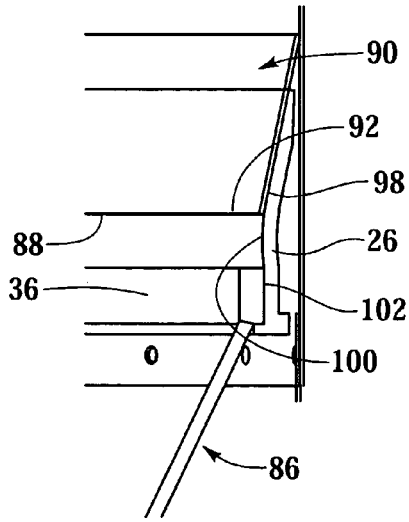
FIG. 4 is an enlarged side sectional view of the juncture between the tank and the shell, including the vibration seal.

As been shown in FIGS. 2 and 3, feed tray 40 includes a liquid inlet 42 for feeding liquid to feed tray 40, a housing 44, a bottom 46 and two side walls 48. Housing 44 includes a divider plate 50, a dispersion plate 52, and a baffle 54 which divide housing 44 into a first chamber 56, a second chamber 58, and a third chamber 60.

Figure 13:
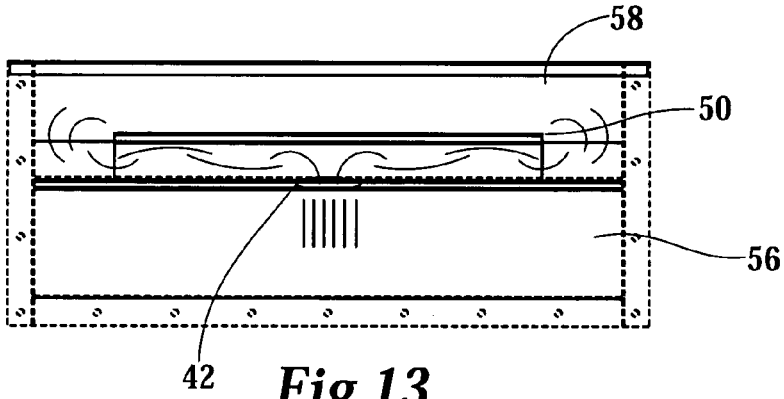
FIG. 13 is a sectional view of the divider plate and the first and second chambers of the feed tray taken along line 13—13 in FIG. 3.
Figure 14:
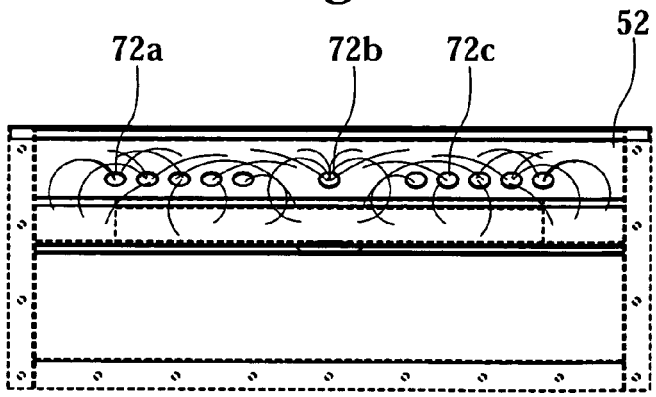
FIG. 14 is a sectional view of the dispersion plate of the feed tray taken along line 14—14 in FIG. 3.

Solid waste to be pulped is placed in feed tray 40. In a preferred embodiment, the liquid fed to feed tray 40 is the same liquid that is extracted from an extractor 62, as described below. Liquid issues from liquid inlet 42 into first chamber 56, the liquid then flows into divider plate 50. The liquid is forced to flow around divider plate 50, as shown in the sectional view of FIG. 13, and into second chamber 58. The liquid flows out of second chamber 58 through dispersion plate 52, where the fluid pressure of the liquid is dispersed into third chamber 60, as shown in FIG. 14 and FIG. 2. Baffle 54 directs the liquid out of third chamber 60 through a discharge slot 64. Because of the dispersed pressure within third chamber 60, the liquid flows out through discharge slot 64 in a smooth, thick film 66 that flows evenly down bottom 46 of feed tray 40, as shown in FIG. 2, with little or no splashing over side walls 48. Thick film 66 acts to flush solid waste that is placed within feed tray 40, without causing turbulent, splashing flow. The liquid and solid waste is flushed into a waste inlet 84 within shell 32, where it falls into tank 30.

Divider plate 50 has a width W2 that extends from a back wall 68 of housing 44 to a dividing wall 70 between first chamber 56 and third chamber 60, as shown in FIG. 3. In one embodiment, the length of divider plate 50 is between about 50% and about 75% of the interior width of housing 44, as shown in FIG. 13. Preferably, divider plate 50 is centered horizontally within housing 44, as shown in FIG. 13 so that an equal volume of liquid will flow around both sides of divider plate 50.

Continuing in FIG. 3, dispersion plate 52 extends from dividing wall 70 to back wall 68 of housing 44 and connects to back wall 68 near the top of housing 44, as shown in FIG. 3. Dispersion plate 52 includes a pattern of holes 72 for allowing the liquid to pass into third chamber 60 and for evenly dispersing the pressure within third chamber 60. In a preferred embodiment, two sets of five holes 72*a*, 72*c* are on each side of a centered single hole 72*b*. Each hole 72 has a diameter of between about 2% and about 5% of the inside width of housing 44. Holes 72*a* and 72*c* are spaced at a length of about 12% of the width of housing 44 away from center hole 72B and are evenly spaced for a length of about 25% of the width of housing 44. However, the present invention is not limited to the above pattern of dispersion plate 52.

Figure 12:
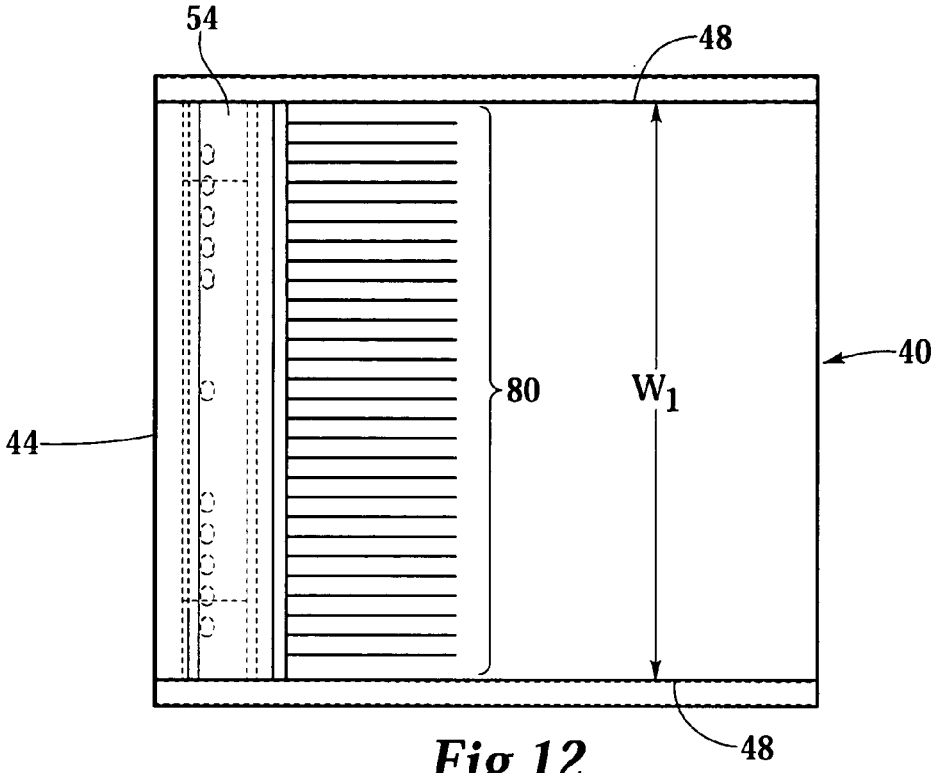
FIG. 12 is a plan view of the feed tray.

Baffle 54 extends from the top of housing 44 towards discharge slot 64 and includes a lip 74 at discharge slot 64. Baffle 54 could have two legs 76 and 78 that form an angle, as shown in FIG. 3, or baffle 54 could be one straight piece. Lip 74 is generally parallel to bottom 46 of tray 40 and extends away from baffle 54 for about ½ inch to about 1 inch. Lip 74 helps to keep the liquid flowing smoothly down bottom 46 of feed tray 40, and helps minimize splashing up side walls 48. Dispersion plate 52 and baffle 54 advantageously distribute flow of the liquid evenly across the width of feed tray 40 in a uniform flow pattern 80, as shown in FIG. 12.

In one embodiment, liquid and flushed solid waste enter tank 30 through a waste inlet in shell 32, which may have a means of avoiding splashing of liquid and solid waste, such as guard flaps 82, shown in FIG. 1.

Shell 32 is preferably generally cylindrical in shape with a generally rectangular waste inlet 84. Feed tray 40 mounts to waste inlet 84 so that liquid and flushed solid waste flows through waste inlet 84 into tank 30. Preferably, the top portion 86 of tank 30 has a cross-section that is circular. In one embodiment, the top portion 86 of tank 30 is generally conical in shape except for a rim 88 of tank 30, which is generally cylindrical in shape. A circular cross-section is preferred because it is desirable to allow shell 32 to be rotationally indexed around tank 30 so that pulping system 10 may accommodate several installation requirements. The rotational indexing of shell 32 allows solid waste to be fed to pulping system 10 from a variety of directions, so that pulping system 10 can be more flexible and fit in many different spaces.

Shell 32 includes a lower portion 90 with a rim 92, having an outside surface 98 and tank 30 includes an upper portion 86 with a rim 88 having an inner surface 100 and an outer surface 102. In one embodiment, shell 32 is designed so that outside surface 98 of lower portion 90 has a diameter that is slightly smaller than the diameter of inner surface 100 of upper portion 86 of tank 30, so that lower portion 90 of shell 32 can be nested within upper portion 86 of tank 30 and outer surface 98 of rim 92 of shell 32 comes into contact with inner surface 100 of rim 88 of tank 30, defining a juncture 36 between shell 32 and tank 30.

Vibration Seal

Because of the large forces involved with pulping the solid waste, a large amount of vibration and liquid turbulence is created within tank 30. This can create the noise problems described above. Furthermore, the high level of liquid turbulence within the tank can cause liquid to leak between tank 30 and shell 32.

To counteract vibration and leaking problems, a vibration seal 26 is placed around the perimeter of shell 32 and the perimeter of tank 30 so that vibration seal 26 is around outside surface 102 of upper portion 86 of tank 30 and outside surface 98 of lower portion 90 of shell 32 so that juncture 36 is covered. Vibration seal 26 minimizes translation of vibration between tank 30 and shell 32, and also minimizes leaks of liquid and solid waste out of tank 30.

In one embodiment, in a relaxed condition, vibration seal 26 has an inside diameter that is slightly smaller than the diameter of outside surface 102 of upper portion 86 of tank 30. Vibration seal 26 is stretched over upper portion 86 and then clamped into position with a clamping means, such as using a large diameter hose clamp. In a preferred embodiment, outer surface 98 of lower portion 90 of shell 32 has a shape of a conic section that mates with inner surface 100 of tank 30 so that lower portion 90 stretches vibration seal 26 even farther, creating a watertight fit between vibration seal 26 and shell 32.

Figure 10:
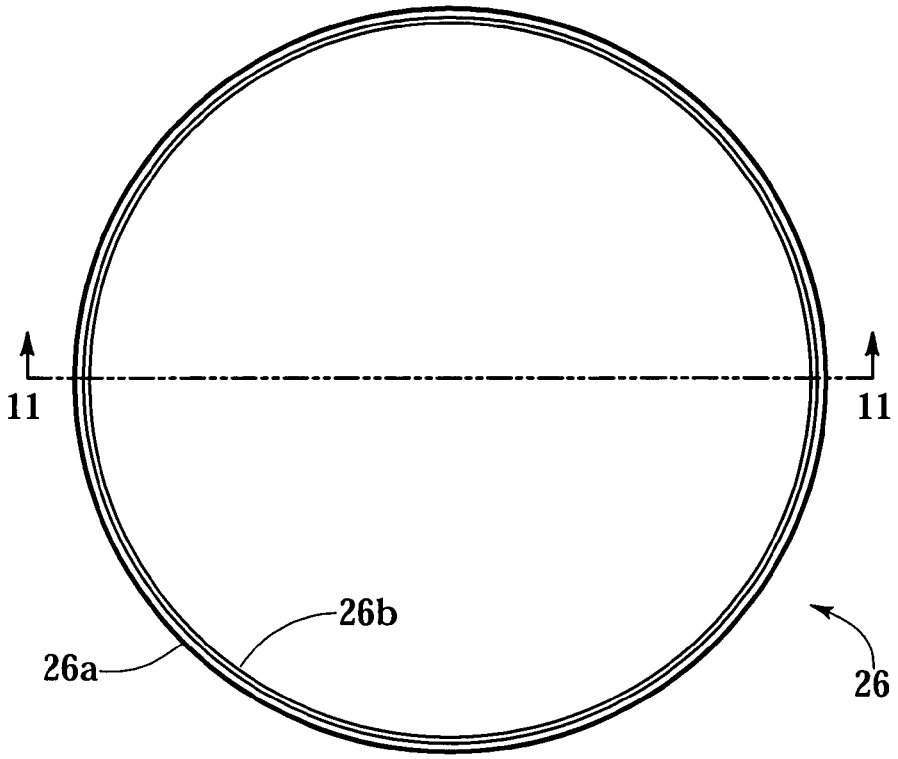
FIG. 10 is a plan view of the vibration seal.
Figure 11:
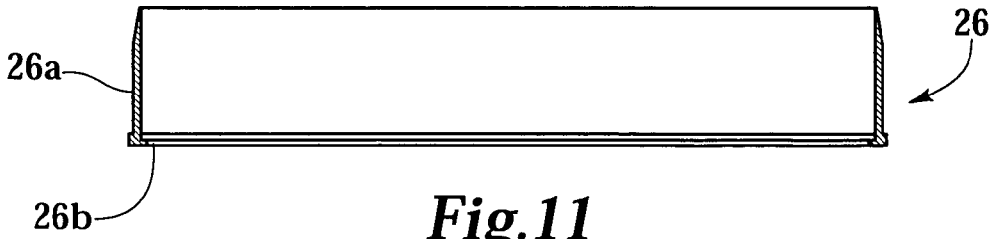
FIG. 11 is a side sectional view of the vibration seal.

In one embodiment, vibration seal 26 is generally cylindrical in shape having side walls 26*b* and an annular base 26*c*, as shown in FIGS. 10 and 11, and is made of molded elastomeric plastic. A preferred material of vibration seal 26 is ether-based polyurethane having a hardness of about 60 durometer, Shore "A" scale.

Pulping Tank

A predetermined amount of liquid is in tank 30 at a predetermined liquid level 104, as shown in FIG. 1. In one embodiment, about 18 to about 20 gallons of liquid are kept in tank 30 during operation of pulping system 10. Tank 30 defines a pulping chamber 106 where waste material to be pulped is placed.

Figure 16:
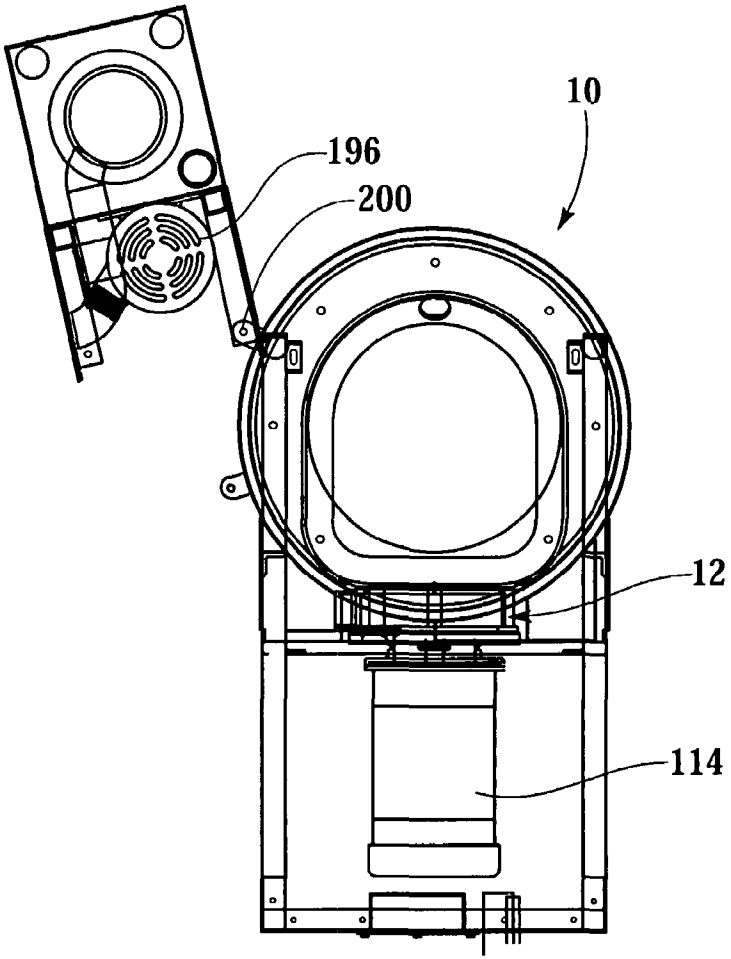
FIG. 16 is a plan view of the pulping system shown in FIG. 15, with one set of the extractor bolts removed, and the extractor housing opened to allow access to the return pump.
Figure 15:
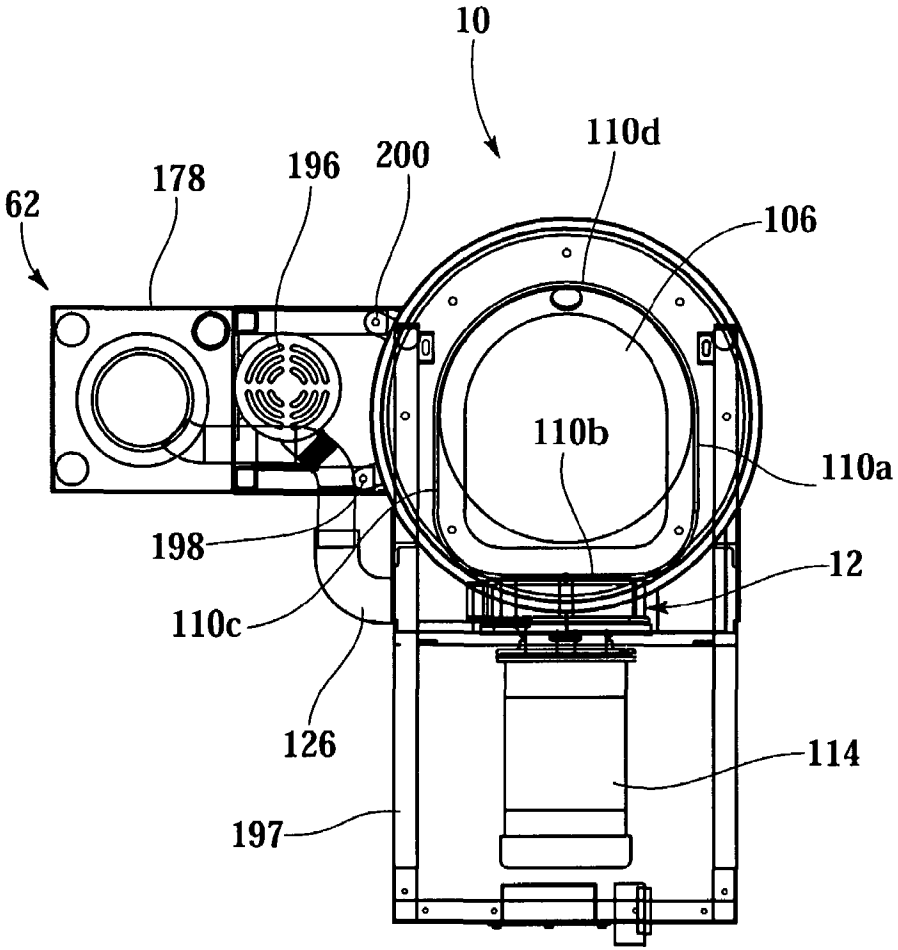
FIG. 15 is a plan view of the pulping system, including a close-coupled extractor, shown without a feed tray or a shell.
Figure 18:
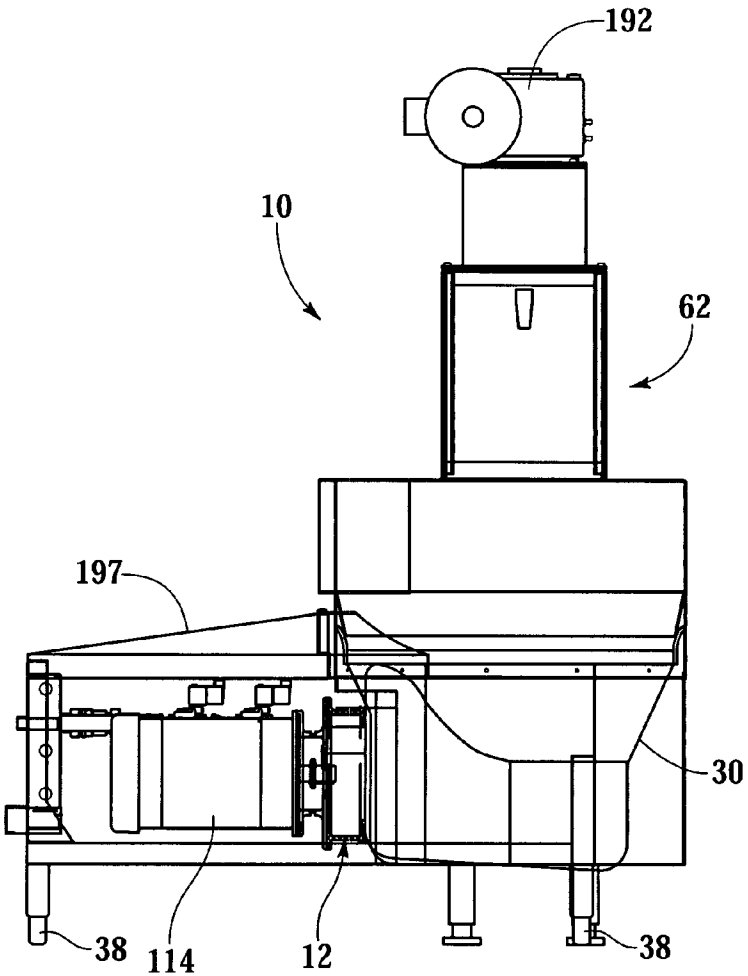
FIG. 18 is a side elevation view of the pulping system with a close coupled extractor.

Tank 30 may have aspects of several different geometric shapes. As shown in FIGS. 15 and 16, in one embodiment, a bottom portion 108 of tank 30 has three side walls 110*a,b,c* and a bottom wall 112, where walls 110*a,b,c* and 112 are generally planar so that cutting mechanism 12 and motor 114 have a generally planar mounting wall 110*b* to be mounted to, with two generally planar side walls 110*a,c* next to mounting wall 110*b*. The remaining side wall 110*d* opposite mounting wall 110*b* is generally curved, or shaped as a section of a cylinder, to allow for the desired circular motion of the liquid and solid waste within the pulping chamber 106. Upper portion 86 of tank 30 is preferred to have a circular cross section so that shell 32 can be rotationally indexed, as described above. To accommodate this indexing, upper portion 86 includes a conical section 116 and a cylindrical section 118, and is provided above bottom portion 108 of tank 30. Directly above bottom portion 108, conical section 116 expands the diameter of tank 30 to a predetermined diameter at cylindrical portion 118. Cylindrical portion 118 includes rim 88 with a perimeter and allows for indexing and sealing of shell 32 with tank 30, as described above.

Planar mounting wall 110*b* also provides a barrier between main pulping chamber 106 and slurry chamber 120, as shown in FIG. 2, where pulped slurry is discharged after being ground by blades 16 of cutting mechanism 12. Slurry chamber 120 is generally cylindrical in shape with a thickness and diameter that are slightly larger than the length and diameter of sieve ring 18, as described below, within predetermined tolerances. After being ground by blades 18, and entering slurry chamber 120 through sizing holes 122 in sieve ring 18, slurry is pumped by a set of pumping vanes 24 attached to impeller 14. The slurry is then pumped through volute 124 of slurry chamber 120 and into piping 126, which carries the slurry to extractor 62.

Cutting Mechanism

Figure 5:
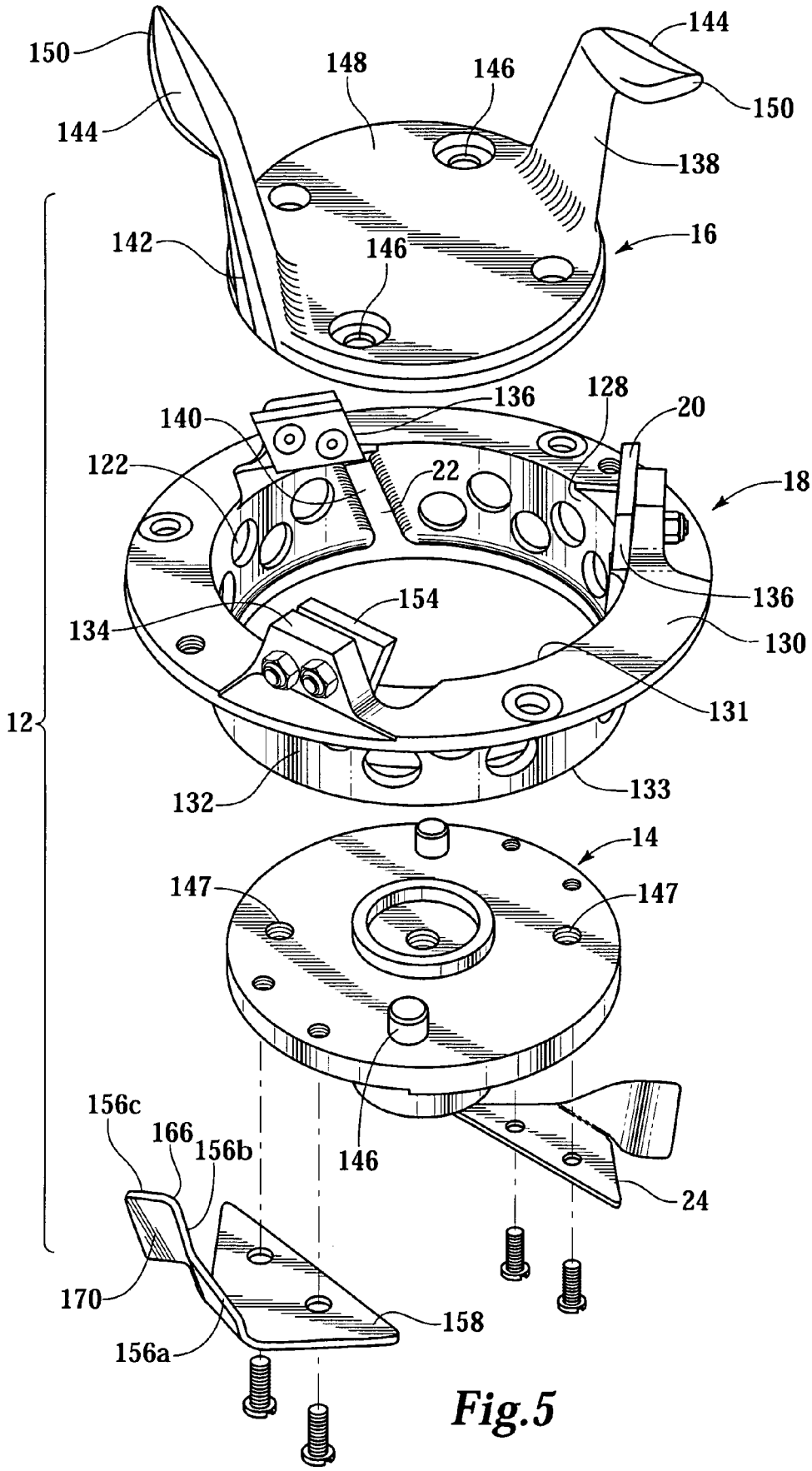
FIG. 5 is an exploded isometric view of the cutting mechanism.

An exploded isometric view of one embodiment of cutting mechanism is shown in FIG. 5. Cutting mechanism 12 is mounted near the bottom of tank 30 on mounting wall 110*b* of tank 30, as shown in FIGS. 2, 15 and 16. Rotating blade 16 of cutting mechanism 12 creates turbulence in the water in tank 30 so that solid waste is drawn toward cutting mechanism 12 where it is ground into a slurry pulp. Cutting mechanism 12 is placed within slurry chamber 120 and includes a rotary impeller 14, a rotating blade 16 connected to impeller 14, a sieve ring 18, stationary blades 20 connected to sieve ring 18, and interrupter bars 22 connected to sieve ring 18. A pulping motor 114 is also included to provide grinding force. Cutting mechanism 12 is mounted on mounting wall 110*b* so that rotating blade 16 is within pulping chamber 106 and so that sieve ring 18 is within slurry chamber 120. Motor 114 is mounted to mounting wall 110*b* so that motor 114 is outside of tank 30 and slurry chamber 120.

Material to be pulped is fed to tank 30 through feed tray 40. The material is drawn toward cutting mechanism 12 where it is ground between rotating blade 16, stationary blades 20, and interrupter bars 22. After being ground to an acceptable size, the material passes through sizing holes 122 in sieve ring into slurry chamber 120. A set of pumping vanes 24 connected to impeller 14 provide the necessary force to pump the slurry from slurry chamber 120 to extractor 62.

It is preferable for cutting mechanism 12 and motor 114 to be mounted on side wall 110B at a predetermined distance from the bottom of tank 30 in order to permit heavier-than-water abrasive solids to settle to the bottom of tank 30. Some materials that may enter pulping system 10 can be solids that form small, abrasive particles which can wear away at parts of the pulping system. Examples of abrasive materials are egg shells and oyster shells that may be broken up by the rotating blades to form small, hard, irregularly-shaped, rough-edged abrasive particles. Circulation of abrasive solids in the vicinity of a seal can compromise the seal and result in liquid leaking out of tank. In prior pulping systems where the cutting mechanism with seal and a directly underlying motor were mounted on the bottom of the tank, abrasive particles would wear against the seal and ultimately cause it to fail. In prior systems, seal failure and resulting leakage of liquid at the bottom of the tank and down onto the motor sometimes resulted in failure of the motor. In the inventive pulping system 10, cutting mechanism 12 is mounted to side wall 110B so that most of the abrasive solids settle to the bottom of tank 30 where they come to rest or circulate below the seal (not shown). In addition, the placement of motor 114 to the side of tank 30 reduces the potential for liquid to leak onto motor 114. Thus, in the inventive pulping system 10, even if some of the solids wear against the seal and cause it to fail, any resulting downward leakage of liquid will tend to be away from the horizontally displaced motor 114. In the event of seal failure, only the seal needs to be replaced, instead of both the seal and motor 114, for considerable savings in maintenance time and expense.

Figure 6:
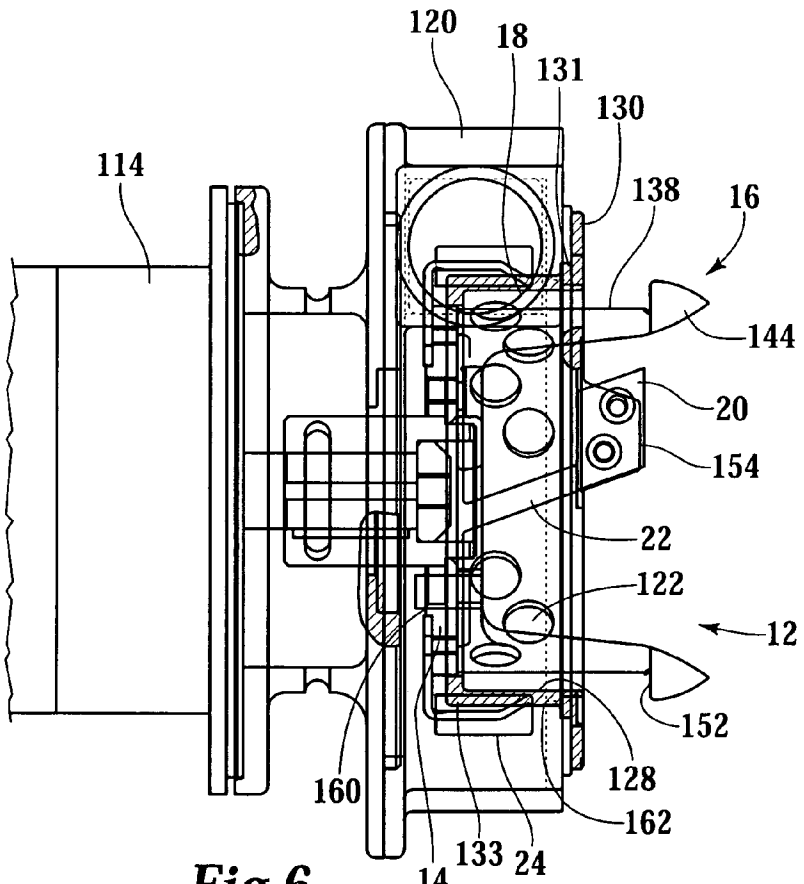
FIG. 6 is a side sectional view of the cutting mechanism.

In one embodiment, impeller 14 is a disk with a diameter that is slightly smaller than the diameter of an inner surface 128 of sieve ring 18 so that impeller 14 fits within sieve ring 18 with a very small tolerance so that liquid and solid waste does not leak between sieve ring 18 and impeller 14 but is forced to be ground by rotating blade 16 and stationary blades 20. Impeller 14 is connected to a driving motor 114, as shown in FIG. 6, which causes it to rotate.

As described above, many prior pulping systems have included a separate slurry pump to provide the energy to push slurry from slurry chamber 120 to extractor 62. However, in the present invention, driving motor 114 provides the energy to grind the solid waste as well as the pumping energy required to move the resulting slurry from slurry chamber 120 to extractor 62.

Sieve ring 18 includes a flange 130 at one end 131 and a cylindrical sieve 132 having a second end 133 axially opposed to flange 130. Cylindrical sieve 132 encircles impeller 14 at end 133 and cylindrical sieve 132 encircles ears 138 of rotating blade 16 throughout the length of cylindrical sieve 132. Flange 130 is connected to mounting wall 110*b* so that cylindrical sieve 132 extends away from pulping chamber 106 of tank 30 into slurry chamber 120, as best shown in FIG. 6. A plurality of sizing holes 122 are included in cylindrical sieve 132 to allow solid waste particles that have been pulped to a certain size to pass through cylindrical sieve 132. Sizing holes 122 are sized so that a predetermined size of pulped solid waste will be allowed to pass. This forces solid waste particles that are larger than sizing holes 122 to remain in pulping chamber 106 until they are ground down to a small enough particle size to pass through sizing holes 122. Preferably, sizing holes 122 are generally circular with a diameter of between about 1.3 cm and about 1.9 cm.

Also included with sieve ring 18 are one or more stationary blades 20 having straight cutting edges 136 so that stationary blades 20 axially extend away from flange 130 into pulping chamber 106 so that stationary blades 20 are generally parallel with ears 138 of rotating blade 16, as described below and shown in FIGS. 6 and 9. Also included in sieve ring 18 are a set of interrupter bars 22 having a helical cutting surface 140 which are integral with inner surface 128 of cylindrical sieve 132 so that interrupter bars 22 project radially inward from inner surface 128 toward the axis of rotation so that they create a predetermined effective diameter, which is defined by helical cutting surface 140 of interrupter bars 22.

As described below and shown in FIGS. 5 and 6, rotating blade 16 has cutting edges 142, which periodically pass by straight cutting edges 136 of stationary blades 20 and helical cutting surfaces 140 of interrupter bars 22 with a close predetermined radial clearance. An effective diameter defined by interrupter bars 22 is chosen so that this predetermined radial clearance is achieved to provide a scissoring action to cut and grind waste material into a slurry.

Rotating blade 16 is connected to impeller 14 so that both impeller 14 and rotating blade 16 rotate in the same direction. Rotating blade 16 is preferably detachably connected to impeller 14, such as by attaching bolts (not shown) threw holes 146 in rotating blade 16 and holes 147 impeller 14 shown in FIG. 5,. Bolts 146 allow for easy removal of rotating blade 16 for maintenance or change-out, without the requirement of special tools. Rotating blade includes a base 148 and a plurality of ears 138 integrally attached to base 148, each ear 138 having a cutting edge 142.

Base 148 is generally circular in shape and is connected to impeller 14 by bolts 146 so that base 148 and impeller 14 are generally parallel to each other. Ears 138 are integrally attached to base 148 and are evenly spaced so that rotating blade 16 is balanced as it is rotated by impeller 14. Ears 138 axially extend away from base 148, past flange 130 and into pulping chamber 106 so that a portion of ears 138 rotate within sieve ring 18, as shown in FIG. 6.

Each cutting edge 142 of each ear 138 is situated so it is facing toward the direction of rotation, see FIG. 5. As rotating blade 16 rotates, ears 138 periodically pass by interrupter bars 22 and stationary blades 20 so that cutting edges 142 pass by helical cutting surfaces 140 of interrupter bars 22 and straight cutting edges 136 of stationary blades 20 within a predetermined clearance to create a scissoring effect between ears 138 and interrupter bars 22 within cylindrical sieve 132 and between ears 138 and stationary blades 20 within pulping chamber 106. Cutting mechanism 12 is designed so that cutting edge 142 of each ear 138 passes by each helical cutting surface 140 of interrupter bars within a predetermined radial clearance, as described above, to provide a cutting or grinding action of the solid waste.

In a preferred embodiment, rotating blade 16 includes two ears 138, each having a cutting edge 142, as shown in FIG. 5. However, the present invention is not limited to a blade having two ears 138, any number of ears 138 can be used so long as they provide adequate pulping of the solid waste and keep rotating blade 16 balanced throughout rotation of impeller 14, but a preferred number of shearing members is two or three so that rotating blade 16 is simple and inexpensive. It is preferred that each ear 138 be at least as long as stationary blades 20, and preferably longer, so that ears 138 axially extend past stationary blades 20 into pulping chamber 106 so that a maximum efficiency of grinding is achieved.

Each ear 138 is angled slightly towards inner surface 128 of cylindrical sieve 132 and cutting edge 142 of each ear 138 is curved. Preferably, cutting edge 142 is curved in a generally helical manner so that each curved cutting edge 142 of each ear 138 can have a close radial clearance with helical cutting surface 140 of each interrupter bar 22 as the blade and bar come into play. As will be appreciated, the helical curvature of each cutting edge 142 and each cutting surface 140 allows the radial clearance between curved cutting edge 142 and helical cutting surface 140 to be very close, and remain substantially constant as each cutting edge 142 of each ear 138 passes each cutting surface 140 of each interrupter bar 22 as rotating blade 16 rotates. This constant and close radial clearance between cutting edge 142 and cutting surface 140 allow rotating blade 16 and interrupter bars 22 to create a scissoring effect within cutting mechanism 12. At the high rotational speeds under which rotating blade 16 spins, this creates highly efficient grinding and cutting, particularly of difficult fibrous materials such as polyethylene and Styrofoam, or traditionally unpulpable materials such as aluminum cans.

Continuing in FIG. 5, one or more of the ears 138 may also include an extension or winglet 144 integrally attached to a distal end 150 of ear 138 that is opposite of base 148, providing that ears 138 are long enough so that winglets 144 do not contact stationary blades 20. Although only one winglet 144 could be used, it is preferred that each ear 138 have a winglet 144 integrally attached so that rotating blade 16 will remained balanced during operation. In one embodiment, winglets 144 form a tail that extends away from its associated ear in a direction opposite to the direction of rotation. Winglets 144 provide extra turbulence within main pulping chamber 106 and also aid in submerging floating objects, such as milk cartons, into the pulping chamber 106 to be pulped by rotating blade 16. The turbulence created by winglets 144 can greatly improve the efficiency and operation of pulping system 10 because the turbulence can minimize bridging of material at sieve ring 18, within pulping tank 30.

Figure 9:
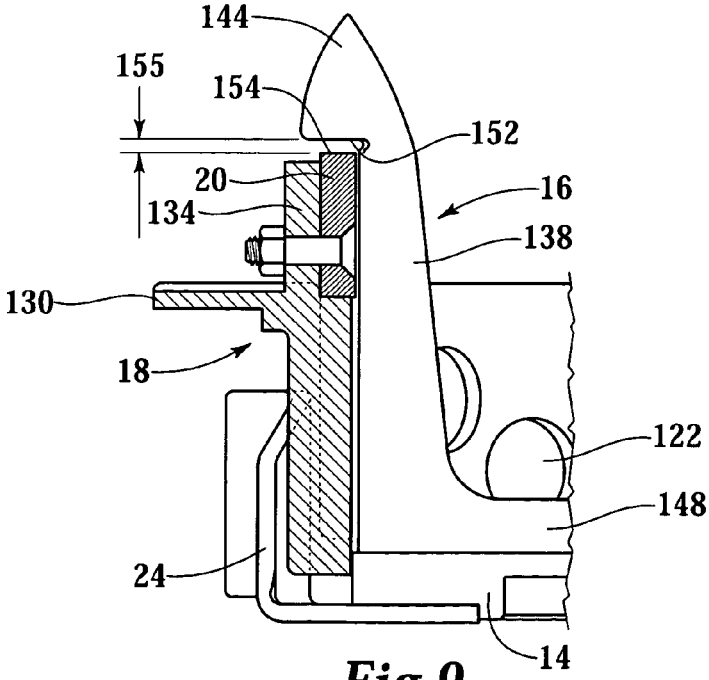
FIG. 9 is an enlarged side sectional view of the cutting mechanism, showing the clearances between the rotating blade and the stationary blade.

Each winglet 144 is integrally attached to an ear 138 so that bottom surface 152 of winglet 144 passes over a top surface 154 of stationary blade 20 with a close axial clearance 155, as shown in FIG. 9. The close axial clearance 155 between bottom surface 152 of winglet 144 and top surface 154 of stationary blade 20 helps to strip any fibrous debris or stringy material which may have accumulated on winglet 144. If the fibrous debris is not removed by some means, it can cause periods in which rotating blade 16 is out of balance, which is undesirably for operation of pulping system 10.

Figure 8:
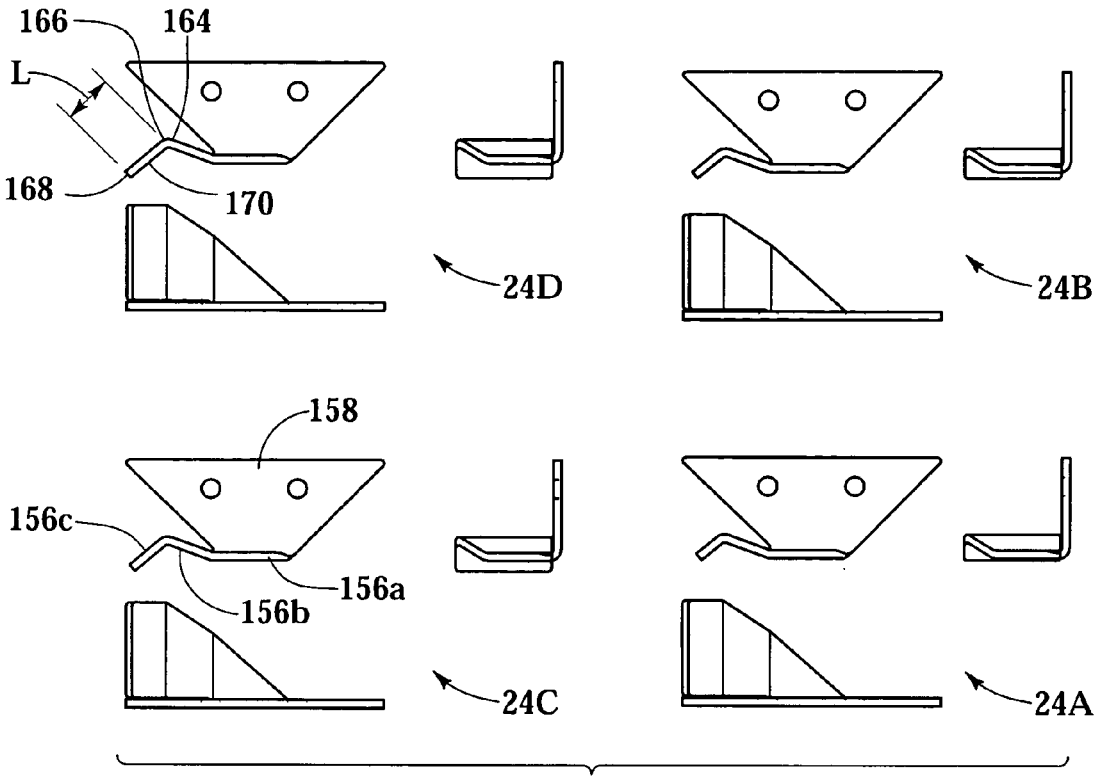
FIG. 8 shows a set of pumping vanes having varying lengths L.

Novel and inventive pumping vanes 24 provide the pumping capacity necessary to pump the slurry from slurry chamber 120 to extractor 62. Pumping vanes 24 can be detachably connected to impeller 14, so that a set of pumping vanes 24 can be provided, each different pumping vane providing a different pumping capacity. In a preferred embodiment, each pumping vane 24 includes a mounting flange 158, a leading leg 156*a* and a trailing leg 156*c*, as shown in FIGS. 5 and 8.

As is best seen in FIG. 6, mounting flange 158 is connected to a back surface 160 of impeller 14 that is opposite of sieve ring 18. This allows mounting flange 158 to extend below sieve ring 18 so that pumping vane 24 will be outside of cylindrical sieve 132. Leading leg 156*a* is connected to mounting flange 158 and is generally perpendicular to mounting flange 158, and leading leg 156*a* is generally parallel to a plane that is tangent to outside surface 162 of cylindrical sieve 132. A rear portion 156*b* of leading leg 156*a* is directed toward the outside surface 162 of sieve ring 18. Leading leg 156*a* is in close proximity to outside surface 162 and provides some help in clearing fibrous debris that may have become lodged in sizing holes 122. In a preferred embodiment, rear portion 156*b* is a middle leg 156*b*.

Figure 7:
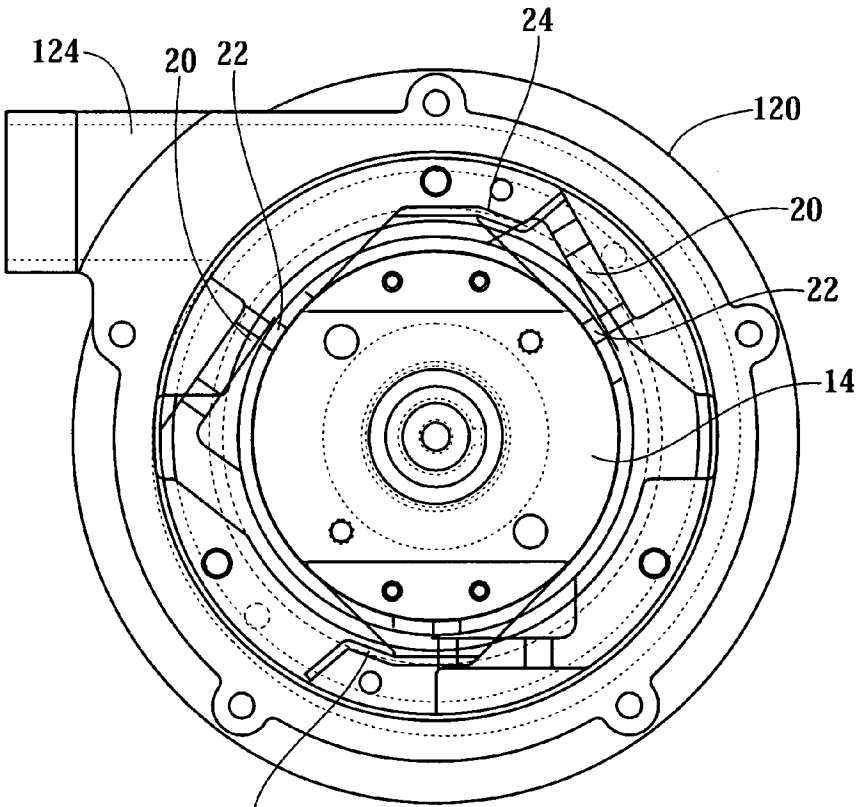
FIG. 7 is a plan view of the cutting mechanism, shown without the rotating blade.

Middle leg 156*b* is connected to leading leg 156*a* and is also generally planar, but middle leg 156*b* is angled toward outside surface 162 of cylindrical sieve 132. Rear end 164 of middle leg 156*b* forms an apex 166, where middle leg 156*b* is connected to trailing leg 156*c*. Trailing leg 156*c* is also generally planar and a rear portion 168 of trailing leg 156*c* is directed away from outside surface 162, as shown in FIG. 7. Apex 166 creates a closest radial clearance to outside surface 162 of cylindrical sieve 132. It is believed that this close radial clearance greatly aids in the removal of fibrous debris from sizing holes 122, and prevents sieve ring 18 from becoming blocked with material. Leading leg 156*a*, middle leg 156*b* and trailing leg 156*c* are preferably generally planar.

Trailing leg 156*c* also provides a pumping surface 170, which is primarily responsible for moving the slurry out of slurry chamber 120 and into extractor 62. As cutting mechanism 12 rotates, the open vane design of pumping vanes 24 acts to push the slurry, including the solid waste particles, into volute 124 and out of slurry chamber 120. In most cases, it is desired to provide the same flow rate of slurry out of slurry chamber 120 because, as described below, it is the flow rate capacity of pulping system 10 that has been found to be related to pulping capacity.

However, different pulping piping configurations create drastically different head conditions. A close-coupled system, where the slurry only needs to be pushed a few feet, has a much smaller head than a remote system, where extractor 62 is 100 feet away. The amount of head for which a particular pumping vane 24 can provide the desired flow rate is directly related to the surface area of pumping surface 170. In order to change this surface area, length L (shown in FIG. 8), is changed. A smaller L provides a smaller pumping capacity, and a larger L provides a larger pumping capacity.

For example, if a remote extractor 62 were used that was 100 feet away from slurry chamber 120, a large pumping vane 24D, as shown in FIG. 8, would be used. Pumping vane 24D requires a high amount of horsepower to push the slurry 100 feet, especially since the length L is large. For this reason, pumping vane 24D would not be ideal for a close-coupled system where extractor 62 is only a few feet or less away from slurry chamber 120. Certainly, pumping vane 24D would get the job done, and push the slurry to extractor 62, but it would require much more horsepower than is necessary. Because of this fact, a better choice would be pumping vane 24A, which has a much smaller length L. Because the distance between slurry chamber 120 and extractor 62 is small in a close-coupled system less head is present so that the pumping vanes do not have to create as high of a pressure change to move the slurry to extractor 62. Therefore, a smaller pumping vane 24A will provide the desired flow rate, without requiring the same amount of energy as pumping vane 24D. Pumping vanes 24B and pumping vanes 24C allow for intermediate distances, or can account for varying fluid conditions and characteristics, which may alter the head. Pumping vanes 24A,B,C and D provide a set of pumping vanes, as shown in FIG. 8, which can be used to select a proper pumping vane 24 for a particular head.

Surprisingly, it has been found that one of the biggest factors affecting the pulping capacity of a pulping system is the flow rate at which the slurry is moved. Traditionally, to make a pulper that had a higher capacity meant making everything bigger, including the pulping tank, the rotating blade diameter, the slurry pump and the grinding motor. This meant a large increase in the cost of the pulper. It has been found that an increase in the slurry flow rate greatly increases the capacity of efficiency of the pulper. In the case of pulping system 10, pumping vanes 24 can provide as much as about 90 gallons per minute to about 120 gallons per minute or more, preferably about 100 gallons per minute through 100 feet of two inch pipe, while most prior pulpers would only provide a flow rate of 25 to 50 gallons per minute.

Pumping vanes 24 also provide the added bonus of eliminating the need for a separate slurry pump in most cases. Prior pulping systems would use a pump with a separate motor from the motor driving the grinding apparatus. Cutting mechanism 12 of the present invention is driven by a single drive motor 114, which provides the energy for grinding and for pumping the slurry. This makes pulping system 10 a simpler system requiring fewer pieces of equipment to operate, and therefore less equipment to maintain.

The present invention allows a supplier to easily customize a pulping system 10 depending on a customer's need. The supplier simply calculates an expected head of pulping system 10, taking into account several factors such as pipe length between slurry chamber 120 and extractor 62, pipe diameter, changes in elevation, fixtures present between slurry chamber 120 and extractor 62 such as turns, or L's in the pipe, and slurry composition.

Once an expected head has been determined, a pumping vane is selected out of a set of pumping vanes, such as the set of pumping vanes 24A,B,C and D shown in FIG. 8, which provides the desired flow rate for the calculated head. For example, a pulping system may be designed for a system with an expected head of the equivalent of 100 feet of 2 inch piping and the desired flow rate is 100 gallons per minute. From prior experimentation, it is known that pumping vanes 24D will provide the desired flow rate for the expected head, so pumping vanes 24D are connected to impeller 14 in pulping system 10. In another example, a close-coupled system may only require the equivalent of a few feet of head through 2 inch pipe, so smaller pumping vanes 24A are chosen and installed.

Another advantage of the present invention is that if, after installation of the system at a customer's location, it is found that the chosen pumping vanes 24 are not quite right, and provide a flow rate different than the desired flow rate, a different set of pumping vanes 24 can be exchanged for the original. In the case of the close-coupled system described above, if the desired flow rate is 100 GPM, and pumping vanes 24A are only providing 80 GPM in the current system, pumping vanes 24A can easily be exchanged for pumping vanes 24B, which may provide the desired flow rate.

Vibration Mounting Assemblies

To minimize the translation of vibration between tank 30 and any working surfaces that may be used around pulping system 10, a vibration mounting assembly 28 is provided, as shown in FIG. 2. Mounting assembly 28 includes a frame 34 and a plurality of vibration mounts 28. In a preferred embodiment, four vibration mounts are used. The entire weight of tank 30, grinding mechanism assembly 12, and drive motor 114 rest on vibration mounts 28 to minimize the translation of vibration to frame 34 and any work surfaces connected to frame 34.

In one embodiment, shown in FIG. 2, each vibration mount 28 is made up of a rubber or plastic bumper 172 and two threaded bolts 174 integral with bumper 172 at opposite ends of bumper 172. Each vibration mount 28 is connected to frame 34 using one of bolts 174. Tank 30 and motor 114 are connected, via supports 176, to vibration mounts 28 using the other bolt 174 on each vibration mount 28. Because all of the weight of the vibrating portions of pulping system 10 rests on rubber vibration mounts 28, vibration is absorbed by vibration mounts 28 instead of being translated to frame 34.

Bumper 172 can be made of any suitable material that can successfully absorb the vibrations created by motor 114 and cutting mechanism 12 within tank 30 and are sufficiently durable and resistant to erosion. Bumper 172 can also be of any suitable geometric shape are size, which should be chosen to adequately support the weight of tank 30, shell 32, feed tray 40, cutting mechanism 12, motor 114 and any other extraneous equipment that is directly attached to these portions of pulping system 10. In one embodiment, bumper 172 is made of a neoprene rubber having a hardness of about 60 durometer, Shore "A" scale, with a cylindrical shape having a diameter of about 2 inches and a length of between about 1.5 inches and about 2 inches. Bolts 174 within bumper 172 may be about ½ inch in diameter and are radially centered at each end of bumper 172.

Extractor

The slurry consists of a high percentage of liquid, most of which is water, along with pulped solid waste. The primary purpose of pulping system 10 is to reduce the amount of waste to a smaller volume, which would not be accomplished if the water and other liquids in the slurry were not removed before disposal of the solid waste. Therefore, a liquid extractor 62 is used to extract the liquid from the slurry.

After pumping vanes 24 have moved the slurry out of slurry chamber 120, it travels through slurry piping 126 and ends up in extractor 62. In one embodiment, shown in FIGS. 1 and 15–18, extractor 62 includes a housing 178, a cylindrical screen 180, and a helical screw 182 placed within cylindrical screen 180.

Figure 17:
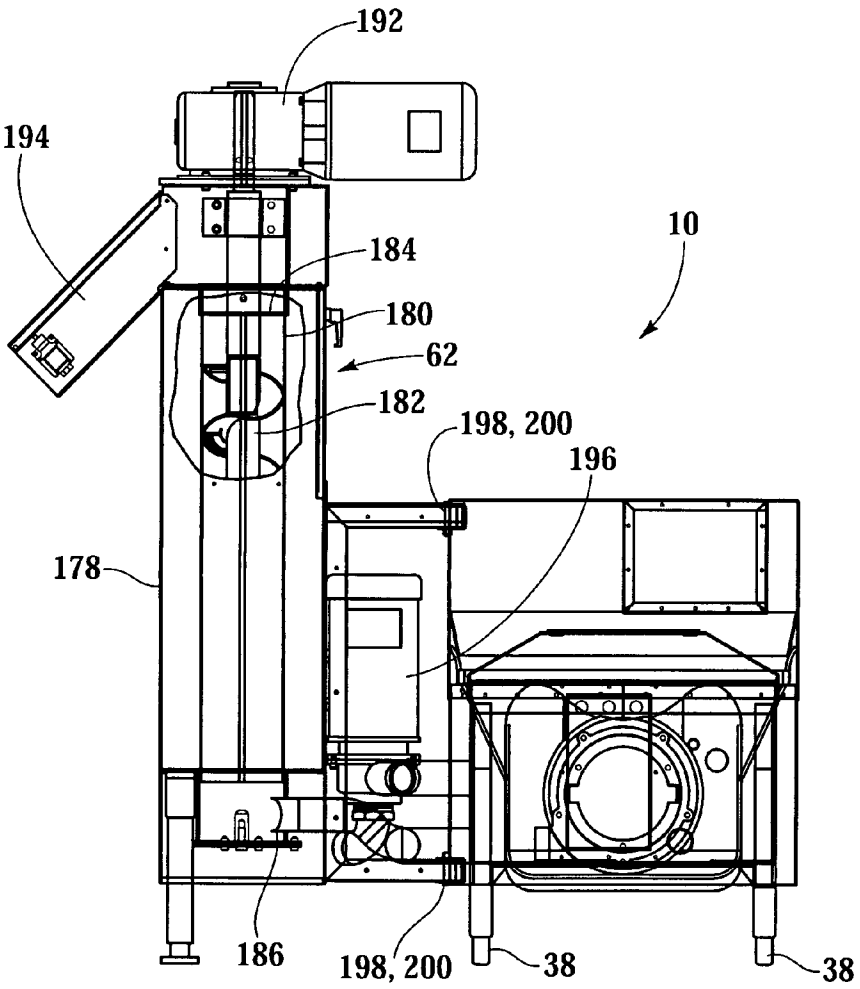
FIG. 17 is a front elevation view of the pulping system with a close coupled extractor.

Slurry enters housing 178 of extractor 62 through a slurry inlet 186 at the bottom of extractor 62, as shown in FIG. 17, where the solid particles are moved up extractor 62 by the rotation of screw 182. Screw 182 is rotated by extractor motor 192 and as screw 182 rotates the solids of the slurry of moved up extractor 62 so that liquid can run off and be forced out through cylindrical screen 180. The remaining solids exit cylindrical screen 180 at top end 184 where it can be feed into chute 194 and fall into a receptacle 195, as shown in FIG. 1.

Quick-Release Extractor Mount

After being removed from the slurry in extractor 62, liquid is returned to feed tray 40 through a return pump 196, which may be located between extractor 62 and tank 30 as shown in FIG. 15. It is desirable to cover components of pulping system 10 with a shroud to keep a clean and safe environment around pulping system 10. It is particularly desirable to shroud moving parts such as pulping motor 114, extractor motor 192 and return pump 196. However, when shrouded it is difficult to access these components for servicing. In the case of pulping motor 114, this problem can be alleviated by providing an access panel (not shown) in a shroud either above or beside pulping motor 114. Similarly, an access panel (not shown) would provide easy access to extractor motor 192.

But, because return pump 196 is located between extractor 62 and tank 30, it is in a difficult location for servicing. The present invention provides a means for accessing return pump 196 by having extractor 62 being connected to tank 30 in a hinged manner, as shown in FIGS. 15 and 16. In one embodiment, extractor 62 is connected to tank 30 with two sets of bolts 198 and 200 where each set has two bolts. When both sets of bolts 198 and 200 are connected to tank 30, they provide a secure connection between extractor 62 and tank 30 during operation of pulping system 10, as shown in FIG. 15. When it is desired to access return pump 196 for servicing, either set of bolts 198 or 200 can be removed while the other set remains connected. For example, bolts 198 can be removed while bolts 200 are kept on place (see FIG. 16). Piping 126 is also flexible and releasably connected to extractor so that it can be detached and removed if needed. After the first bolts 198 have been removed, the second bolts 200 act as a pivot for a hinge so that extractor 62 and return pump 196 can be swung out, allowing access to return pump 196 for servicing, as shown in FIG. 16. The hinged connection of the present invention provides a way to shroud components of pulping system 10 for safety and cleanliness, without hindering access to serviceable parts such as return pump 196.

The liquid extracted in extractor 62, usually referred to as return water, can then be fed back into tank 30. In a preferred embodiment with feed tray 40 included, the return water is fed to through return piping 127, see FIG. 1, where it is routed to a return line 204 to liquid inlet 42, as shown in FIGS. 1 and 2, of feed tray 40 so that it can be dispersed and used to flush new solid waste to be pulped into tank 30, as described above.

The pulping system 10 of the present invention provides many advantages over prior pulping systems. Novel and improved cutting mechanism 12 includes novel pumping vanes 24, which advantageously combine the operation of grinding, and pumping into one assembly having a single motor 114. Different pumping vanes 24A,B,C and D allow the present invention to provide the desired pumping capacity for a given pulping operation, be it a close-coupled system or a remote system so that motor 114 operates within its horsepower budget while maximizing throughput and pulper performance. Pumping vanes 24 and rotating blade 16 also provide novel and improved means of removing fibrous debris from sizing holes 122, stationary blades 20 and winglets 144. Vibration seal 26 and vibration mounts 28 minimize translation of vibration between the pulping tank 30 and its surroundings, particularly shell 32 and frame 34, removing a common problem among pulpers. The present invention also provides a novel and improved feed tray 40 that evenly disperses return water across the width W1 of feed tray 40 without splashing to flush solid waste into tank 30 for pulping. Finally, the present invention provides a quick-release mounting of extractor 62 to allow easy service access.

The present invention is not limited to the above-described embodiments, but should be limited solely by the following claims.

What is claimed is:

1. A waste pulping apparatus comprising:

a tank for containing liquid and solids, the tank having an upper portion with a perimeter;

a frame for supporting the tank;

means for pulping the liquid and solids in the tank;

a shell having a lower portion with a perimeter;

wherein the tank and the shell are nested defining a juncture between the tank and the shell at the perimeters;

a seal placed at the juncture for preventing the liquids from leaving the tank and for minimizing the translation of vibration between the tank and the shell; and at least one mounting assembly placed between the tank and the frame for mounting the tank onto the frame while minimizing translation of vibration between the tank and the frame.

2. A waste pulping apparatus according to claim 1, wherein the mounting bracket includes a bumper.

3. A waste pulping apparatus according to claim 1, wherein the bumper is made from neoprene rubber.

4. A waste pulping apparatus according to claim 1, wherein the lower portion of the shell is nested within the upper portion of the tank.

* * * * *